United States Patent [19]

Hayes

[11] Patent Number: 4,856,461

[45] Date of Patent: Aug. 15, 1989

[54] MULTIPLE TUBE STEAM DRYER FOR MOISTURE SEPARATOR REHEATER

[75] Inventor: James K. Hayes, Chattanooga, Tenn.

[73] Assignee: Combustion Engineering, Inc., Windsor, Conn.

[21] Appl. No.: 151,012

[22] Filed: Feb. 1, 1988

[51] Int. Cl.[4] ..... F16T 1/00; F22B 37/26

[52] U.S. Cl. ..... 122/488; 55/348

[58] Field of Search ..... 122/483, 488, 489; 55/345, 346, 347, 348, 398

[56] References Cited

U.S. PATENT DOCUMENTS

| | | | |
|---|---|---|---|
| 3,895,930 | 7/1975 | Campolong | 55/399 X |
| 4,629,481 | 12/1986 | Echols | 122/488 X |
| 4,671,214 | 6/1987 | Alias et al. | 122/488 |
| 4,717,400 | 1/1988 | Ozeki et al. | 122/488 X |
| 4,767,424 | 8/1988 | McEwan | 55/348 X |

OTHER PUBLICATIONS

J. P. Monat, et al., "Accurate Evaluation of Chevron Mist Eliminators", Chemical Engineering Progress, Dec. 1986 (pp. 32–39).

M. J. Moore, et al., Two-Phase Steam Flow In Turbine and Separators, Chapter 7, "External Water Separators" (1967).

*Primary Examiner*—Edward G. Favors

*Attorney, Agent, or Firm*—Chilton, Alix & Van Kirk

[57] ABSTRACT

A moisture separator reheater (12) comprising a wet steam region (32) for containing moisture laden water vapor and a dry steam region (36) containing dry water vapor. An entrance tube (74, 118, 152, 174) is fluidly connected to the wet steam region. Swirlers (76, 134, 178) or similar deflection structure (170, 172) are provided for separating the flow of steam through the entrance tube into liquid and vapor streams. A concentric exit tube (86, 136, 176), or similar structure (158), directs the flow of the vapor stream into the dry steam region while bypassing the liquid stream. The tubes and associated structure are preferably arranged in a steam dryer assembly bundle (54) having a lower plate (128), a plurality of entrance tubes secured to the lower plate, and an upper plate (126) through which the exit tubes pass. The wet steam enters the tubes of the dryer assembly bundle from the steam region below the lower plate, and the liquid extracted during demoisturization is directed into a region (34) between the plates, while the dry stream flows through the exit tubes into the dry steam region above the upper plate.

15 Claims, 7 Drawing Sheets

MULTIPLE TUBE STEAM DRYER FOR MOISTURE SEPARATOR REHEATER

BACKGROUND OF THE INVENTION

The present invention relates to steam dryers, and more particularly, to steam dryers as contained in moisture separator reheaters.

Moisture separator reheaters (MSR) are an important part of commercial nuclear power plants that use light water nuclear reactors. In these types of power plants, saturated steam is produced at relatively low pressures which, if allowed to expand continuously through the turbine, would exhaust at 20–24% moisture. This excessive moisture would impair the efficiency of the turbine blades and cause them to erode at a rapid rate. Moisture separator heaters are provided to remove the moisture from and then super heat high pressure turbine exhaust steam, for use in subsequent turbine stages.

Conventional MSR's are of two general types, those utilizing a moisture separator mesh, and those utilizing chevrons or similar flow deflection devices. In both types of conventional MSR's, a significant portion of the demoisturized, "dry" steam is exposed to "wet" steam before the dry steam enters the reheater tube bundle area. This reduces overall MSR efficiency.

SUMMARY OF THE INVENTION

Process steam entering an MSR typically contains moisture ranging from approximately 2 to 8%. To achieve high efficiency in the MSR, it is desirable to remove as much of this moisture as possible before the steam flows across the reheater tube bundle. If all the moisture is removed then the steam will be super heated the maximum amount before flowing to the low pressure turbines thus providing the highest efficiency possible.

It is thus an object of the present invention to achieve high efficiency of steam drying in a moisture separator reheater.

It is a more particular object of the present invention to remove a significantly greater portion of the moisture in the wet steam, before the demoisturized steam is introduced into the reheater portion of the MSR.

This object is accomplished in accordance with the present invention, with a moisture separator comprising a wet steam region for containing moisture laden water vapor and a dry steam region containing dry water vapor. An entrance tube is fluidly connected to the wet steam region. Swirlers or similar deflection structure is provided for separating the flow of steam through the entrance tube into liquid or vapor streams. A concentric tube, or similar structure, directs the flow of the vapor stream into the dry steam region while bypassing the liquid stream.

Such a moisture separator is, in a preferred embodiment, adapted for use in a moisture separator reheater unit having first, second and third internal regions, the first region adapted to receive wet process steam from outside the unit, the second region adapted to receive wet steam from the first region and separate the moisture therefrom, and the third region adapted to receive and reheat the demoisturized, dry steam from the second region. A plurality of demoisturizer tube assemblies are located in the second region and fluidly connected between the first and third regions. Each tube assembly includes an entrance tube fluidly connecting the first and second regions, and a flow deflector or other structure for imparting a swirling or deflected motion to the steam as it passes through the entrance tube. An outer tube or other guide means is provided for directing the separated liquid stream portion of this deflected away from the separated dry steam, whereas a tube, cone or other structure is provided for directing the dry stream out of the path of the wet stream, and into the third region.

The tube assemblies can be connected to first and second plates. The first plate defines the boundary between the first and second regions, and the second plate defines the boundary between the second and third regions.

In some embodiments of the invention, the separated dry stream enters a separate tube which is in fluid communication between the entrance tube and the third region. In another embodiment, the entrance tube extends from the first region to the third region, with the moisture content being spatially separated within and then extracted from the tube, along the tube length, such that only dry steam is delivered to the vapor region.

The present invention is particularly well suited for use as replacement dryers in existing MSR's. The multiple tube dryer assemblies having a plurality of tube dryers in accordance with the invention, can be more easily manufactured and installed relative to the replacement or upgrading of existing dryer components in MSR's. Furthermore, the pressure drop associated with at least some of embodiments of the present invention, should be similar or less than that associated with existing original equipment. These advantages are in addition to the basic improvement in efficiency of moisture extraction from the process steam, due to the reduction in the contact between vapor stream and the liquid stream after separation, relative to known equipment.

BRIEF DESCRIPTION OF THE DRAWINGS

These and other objects and advantages of the invention will be described in more detail below with reference to the accompanying drawings, in which.

DESCRIPTION OF THE PREFERRED EMBODIMENT

Figure 1:
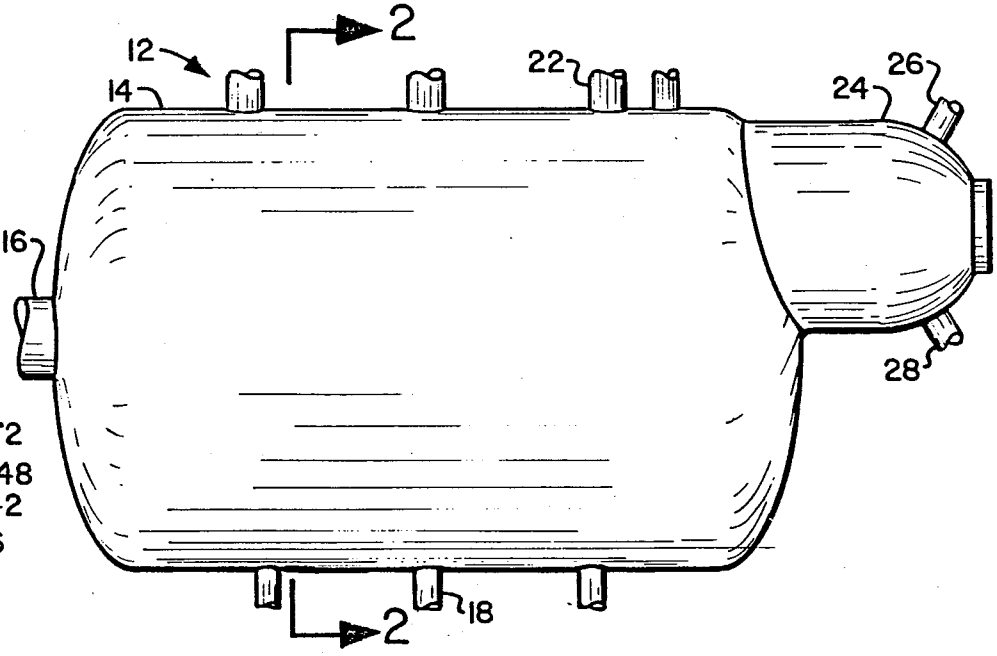
FIG. 1 is a side elevation view of a typical moisture separator reheater.

FIG. 1 shows a typical moisture separator reheater 12 in the form of a shell defining a horizontally oriented closed, substantially cylindrical vessel 14 having a longitudinal axis. At one end of the shell, a wet process steam inlet 16 receives steam from the high pressure turbine stage and delivers the steam to the dryer and reheater sections of the MSR. The extracted water is removed from the vessel 14 through drain nozzles 18, and the dried, reheated (super heated) steam is delivered to subsequent turbine stages through outlet nozzles 22. The heat for reheating the dried steam is transferred through a reheater tube bundle in the upper portion of the vessel, the tubes having a flow of hot steam therein which enters the tube bundle head 24 through heating steam inlet 26, and after passing through the tubes within the shell, the condensate exits the tube bundle head through a drain 28.

Figure 2:
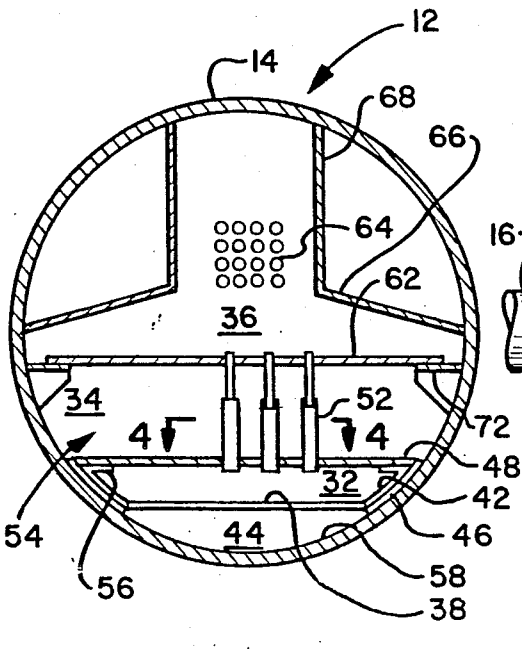
FIG. 2 is a section view taken along line 2—2 of FIG. 1, showing a steam dryer assembly incorporated into the conventional MSR, in accordance with a first embodiment of the present invention.

FIG. 2 is a cross sectional view of the MSR 12 incorporating a first embodiment of the present invention. Conventionally, the MSR is divided into three main sections or regions, which are shown in FIG. 2 as the steam inlet plenum or wet steam region 32, the demoisturizing or dryer region 34, and the dry steam or reheat region 36. The steam inlet plenum 32 typically has a floor 38 and side walls 42, which are spaced from the shell. These define a condensate drain plenum 44 and a condensate flow annulus 46 which provides a flow path from the demoisturizing region 34 to the condensate drain plenum 44. The wet steam region 32 is separated from the demoisturizing region 34 by a lower plate 48. As will be described more fully below, in accordance with the present invention the plate 48 has connected therto a multiplicity of individual tube steam dryer assemblies 52, thereby forming a steam dryer bundle 54. A plurality of bundles 54 can be located side by side transverse to the axis of the MSR. The lower plate 48 of each dryer bundle 54 is positioned on, and preferably attached to, a lower support fixture 56 extending longitudinally along the shell inner surface 58.

An upper plate 62 separates the demoisturizing region 34 from the dry steam region 36. Steam which has been dried in the demoisturizing region is then substantially in vapor form and passes upwardly as a vapor through the dry steam region 36, absorbing heat as it contacts the reheat bundle tubes 64, which typically extend longitudinally in the shell. The reheat or dry steam region 36 typically includes a funnel-like boundary 66 that directs vapor inwardly and a substantially vertical stack portion 68 in which the reheat tubes 64 are located. The upper plate 62 typically is secured to another set of support fixtures 72 running longitudinally along the shell inner surface 58.

Figure 3:
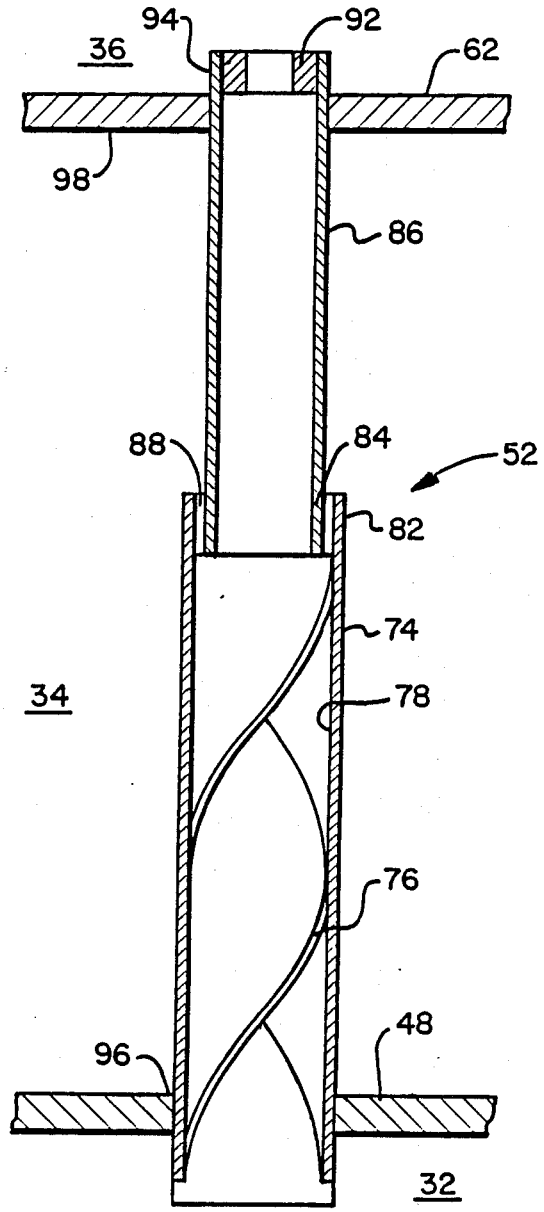
FIG. 3 is an enlarged, sectioned elevation view of a single dryer assembly from the multitube steam dryer assembly bundle shown in FIG. 2.
Figure 5:
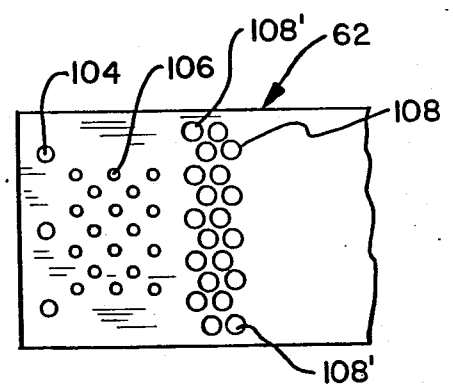
FIG. 5 is a section view taken along line 5—5 of FIG. 2, showing the types of openings in the upper support plate of the first embodiment of the invention.
Figure 4:
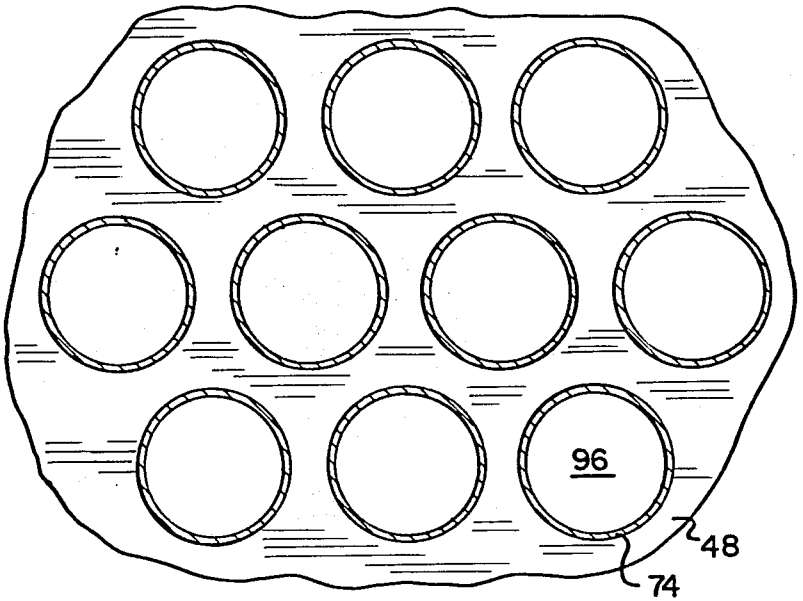
FIG. 4 is a section view taken along line 4—4 of FIG. 3, showing the spatial relationship of the individual dryer assemblies.

FIG. 3 shows the details of an individual steam dryer assembly 52. An entrance tube 74 is preferably welded to the lower plate 48 and extends in the direction of steam flow from the steam inlet plenum 32 into the demoisturizing region 34. The entrance tube 74 includes a helical swirler 76 or other steam deflecting structure along substantially its entire length, whereby the swirling motion of the steam causes the liquid entrained therein to migrate toward the inner surface 78 of the entrance tube wall. The upper end 82 of the entrance tube 82 is spaced below the upper plate 62 and receives the lower end 84 of a coaxial exit tube 86 which is welded to the upper plate 62 and fluidly connects the entrance tube 74 to the dry steam region 36 through the upper plate. The telescoping relationship of the tubes defines an annulus 88 therebetween by which the separated liquid stream having a high moisture content and water droplets passes through the annulus 88 into the open area between the tubes 74 in the demoisturizing region 34, and the separated dry vapor stream, which is more centrally located within the entrance tube, passes directly into the exit tube 86 and upwardly into the dry steam region 36. If desired, an orifice plate 92 can be provided at the upper end 94 of the exit tube to adjust the flow rate or pressure drop through the assembly 52.

Much of the liquid stream discharged through annulus 88 impinges on the lower surface 98 of the upper plate 62. Eventually the liquid water accumulates on the lower support plate 48 where it flows slowly to the sides and passes through the condensate flow annulus 46 into the condensate drain plenum 44 (see FIG. 2). Any low quality steam in the steam demoisturizing region 34, between the tube assemblies 52, tends to accumulate as liquid on the outer surfaces of the entrance tube 74 and the exit tube 86. The liquid stream flowing upwardly through the annulus 88 prevents any liquid that might accumulate on the outer surface of the exit tube 86, from falling back into the entrance tube 74 where it would diminish the drying capability of the swirler 76.

Each dryer tube assembly bundle 54 includes a multiplicity of individual steam dryer assemblies 52. FIGS. 2–6 show the construction of a single dryer tube bundle 54. A typical MSR vessel 14 may be 40 feet in length and nine feet in diameter. In accordance with the preferred embodiment of the invention, each dryer tube bundle 54 has a lower plate 48 that is approximately twelve inches wide and eight feet long. Each entrance tube O.D. is approximately one inch, and the tubes 74 are connected to holes 96 arranged on a triangular array in the plate 48, having a center-to-center pitch of 1.25 inches. Typically, thirty bundles 54 would be supported within the MSR, each bundle having 595 dryer assemblies 52, for a total of 17,850 individual dryer assemblies contained within the vessel 14.

The lower support plate 48 includes holes 98 at either longitudinal end for accepting bolts (not shown) to connect the lower support plate 48 to the fixtures 72. No flow is provided through the surface of the lower support plate 48, except through the entrance tubes 74. In each dryer tube bundle 54, a plurality of alignment pins 102 are welded to holes 96′ in the lower plate 48 (or upper plate 62), instead of entrance tubes.

Figure 7:
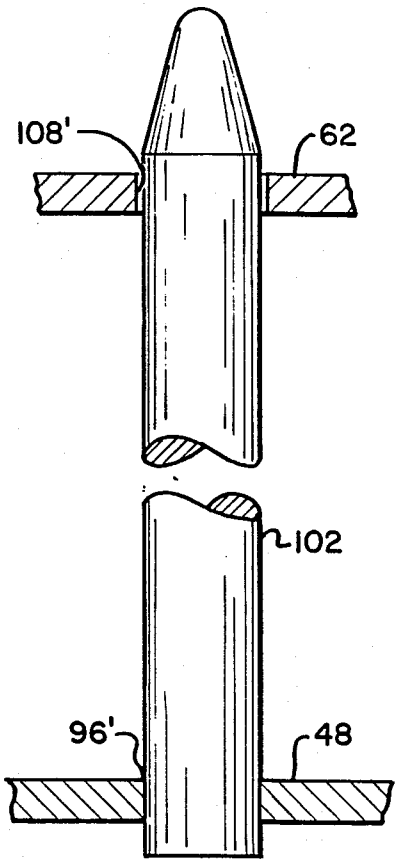
FIG. 7 is a typical alignment pin engaged between the lower plate and the upper plate.
Figure 6:
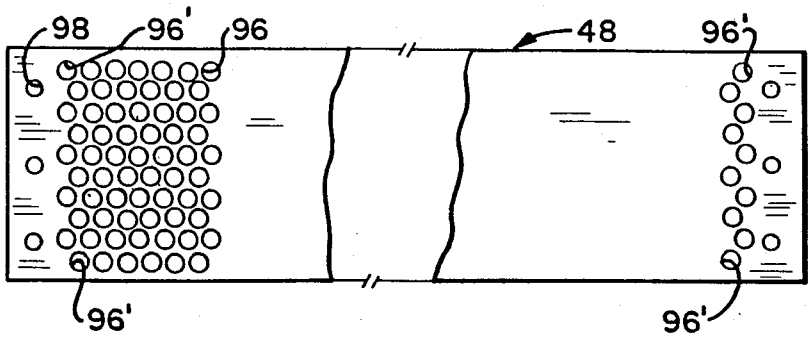
FIG. 6 is a top view of the steam dryer tube bundle lower plate, showing the holes into which alignment pins and dryer tubes are secured.

The upper support plate 62 is generally longer than the lower support plate 48 and, at its long ends, includes not only bolt holes 104, but also a plurality of auxiliary flow holes 106. This permits vapor which enters the demoisturizing region 34 between the dryer assemblies 52 of the tube bundle 54, to flow upwardly from the demoisturizing region 34 into the funnel portion 66 of the dry steam region 36 and thus eventually to the reheat bundle 64. The remainder of the holes 108, 108′ are aligned with corresponding holes 96, 96′ in the lower support plate 48. As shown in FIG. 7, the alignment pins 102, which are rigidly connected to one of the plates 48, are in sliding engagement with the alignment holes in the other plate. This permits precise coaxial registry of each exit tube 86 with its corresponding entrance tube 74 as shown in FIG. 3.

Figure 8:
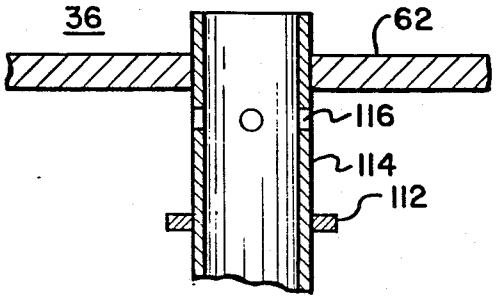
FIG. 8 is a partial sectional elevation view, a variation of the first embodiment of the invention shown in FIG. 3.

FIG. 8 shows a variation of the exit tube of FIG. 3, wherein a water deflector ring 112 or the like is spaced annularly around the exit tube 114 above the upper end 82 of the entrance tube 74. The liquid stream exiting the annulus 88 (FIG. 3) impinges on the deflector 112 and is redirected toward the lower plate 48. The main flow of dry steam passes upwardly through the exit tube 114 into the dry steam region 36. A plurality of floW holes 116 are provided in the exit tube 114 immediately below the upper plate 62, to permit any relatively low moisture steam in the demoisturized region 34, to enter the exit tube 114 and flow upwardly into the dry steam region 36, while being shielded from contact with the liquid stream by the deflector ring 112.

Figure 9:
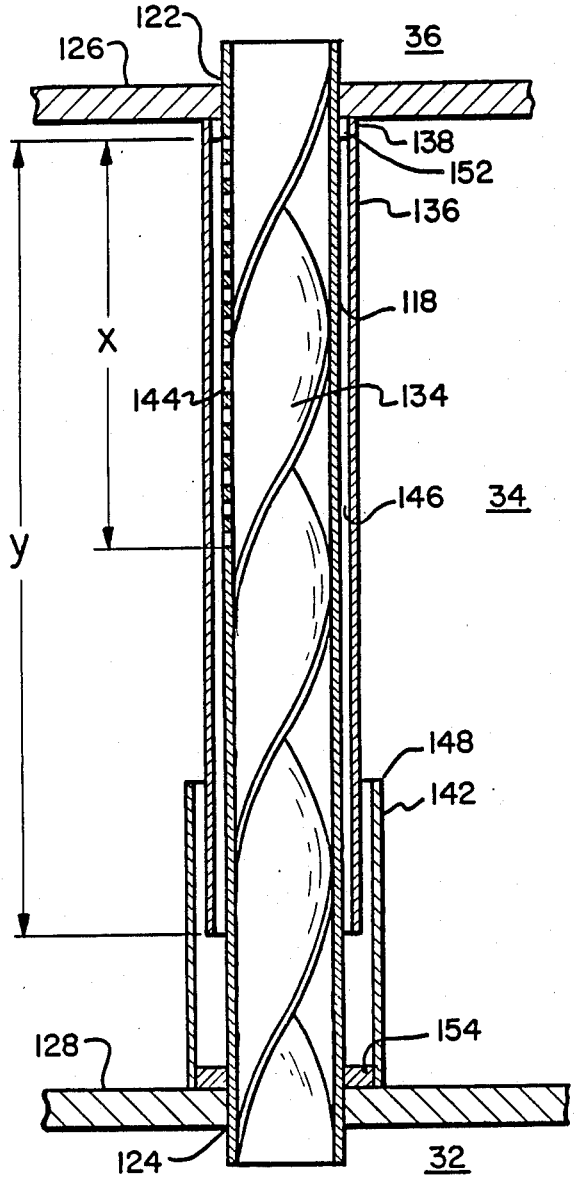
FIG. 9 is a sectioned, elevation view of a second embodiment of a steam dryer assembly, corresponding to the view of the first embodiment shown in FIG. 3.

FIG. 9 illustrates a second embodiment of the invention, in which the entrance tube is in the form of an inner tube 118 which extends from the steam inlet plenum 32 to the dry steam region 36, i.e., across the full height of the demoisturizing region 34. The upper 122 and lower ends 124 of the inner tube are sealed against the upper 126 and lower plates 128, respectively. A swirler 134 or the like extends longitudinally along the full length thereof.

A jacket tube 136 is sealed at its upper end 138 against the inner tube 118 near the upper plate 126 and extends downwardly to an elevation spaced from the lower plate 128. A seal tube 142 of greater diameter than the jacket 136 is sealed against the lower plate 128 and extends upwardly in overlapping relation with the jacket tube 136. This arrangement provides a water seal between the steam flowing in tube 118 and region 34. During operation of the MSR, it is expected that a water layer having a depth up to about 3 inches will cover the plate 128. If the jacket tube 136 is designed to extend below the anticipated water level on plate 128, then the water seal can be achieved without providing the seal tube 142.

The inner tube 118 is perforated 144 for an extent x approximately equal to half the length y of the jacket 136, from the vicinity of the upper plate 126 and extending downwardly.

The effect of this arrangement is that as steam from the inlet steam plenum 32 rises through the inner tube 118, the swirler 134 effect is similar to that in the entrance tube 74 of the embodiment shown in FIG. 3. Instead of exiting the inner tube 118 along an annulus, however, in the second embodiment the separated liquid stream exits radially through the perforations 144 and impinges on the jacket tube 136. The dry vapor stream that remains more centrally positioned along the axis of the inner tube 118, rises into the dry steam region 36, whereas the liquid passing through the perforations 144 flows downwardly in the annulus 146 between the inner tube 118 and the jacket 136 until it accumulates in the seal tube 142. As liquid fills the seal tube, it will overflow onto the lower plate 128. The liquid level between the jacket tube 136 and inner tube 118 will be only slightly higher than the top 148 of the seal tube 142 during normal operation. The water seal in the seal tube prevents steam flow from occurring along with the condensate drain from each tube.

An advantage of this arrangement is that the structure for sealing the jacket tube 142 relative to the inner tube 118, and the seal tube 142 relative to the inner tube 118, can be in the form of press fit plugs 152, 154, which facilitates rapid fabrication.

With this embodiment, the upper plate 126 is not absolutely necessary, because the liquid stream is clearly and distinctly separated from the vapor stream and is confined in annulus 146 for a considerable distance along the exterior of the inner tube 118 until it enters the seal tube 142. Thus, the physical separation between the demoisturizing region 34 and the dry steam region 36 afforded by the upper plate 126 could, in a very low cost embodiment, be eliminated. Tests show, however, that the performance of the dryer assemblies is enhanced by inclusion of the upper plate 126 since the high temperatures at which the MSR operates produces a considerable mist that would rise upward from plate 128 into the dry steam region 36.

Figure 10:
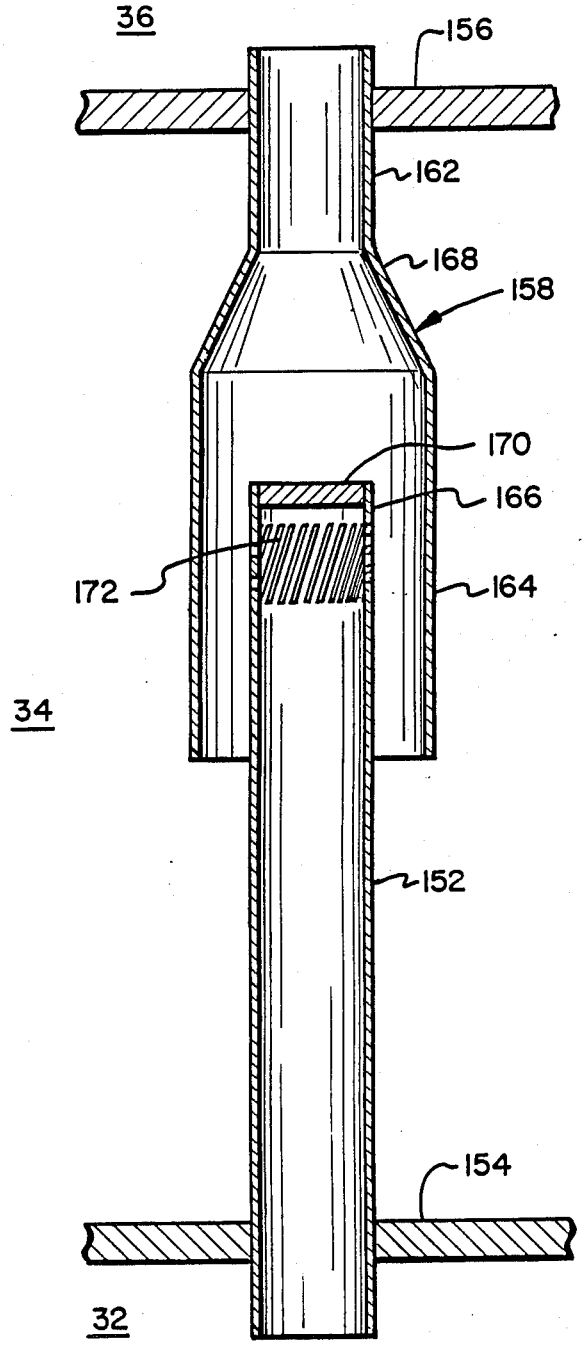
FIG. 10 is a sectioned, elevation view of a third embodiment of a steam dryer assembly.

FIG. 10 illustrates another embodiment of the dryer assembly. The entrance tube 152 is rolled in place against the lower plate 154 and extends into the demoisturization region 34 but is spaced from the upper support plate 156. A funnel-like exit tube 158 has a smaller diameter neck portion 162 rolled into the upper plate 156, a larger diameter skirt portion 158 concentrically overlapping and spaced from the upper portion 166 of the entrance tube 152 and a conical section 168 connecting the neck and the skirt above the upper end 166 of the entrance tube. The upper end 166 of the entrance tube 152 is sealed, as by a press fit plug 170. A series of slots 172 or other perforations having a flow area cumulatively equal to the cross sectional area of the entrance tube 152, are formed at the upper end 166 of the entrance tube in the portion situated adjacent the skirt portion 164 of the exit tube 158. The skirt portion 164 extends downwardly below the slots 172.

Wet process steam flows through the entrance tube 152 and exits through the perforations 172. As the wet steam contacts the inside diameter of the skirt portion 164 of the exit tube 158, the liquid separates and falls by gravity to the upper surface of the lower plate 154. As in the other embodiments, the liquid then flows along the lower plate 154 to the annulus 46 between the inlet steam plenum 32 and the outer shell 14. The separated vapor will flow upward in the skirt 164 at low velocity until it enters the conical and neck portions 168, 162 of the exit tube 158 and into the dry steam region 36.

Figure 11:
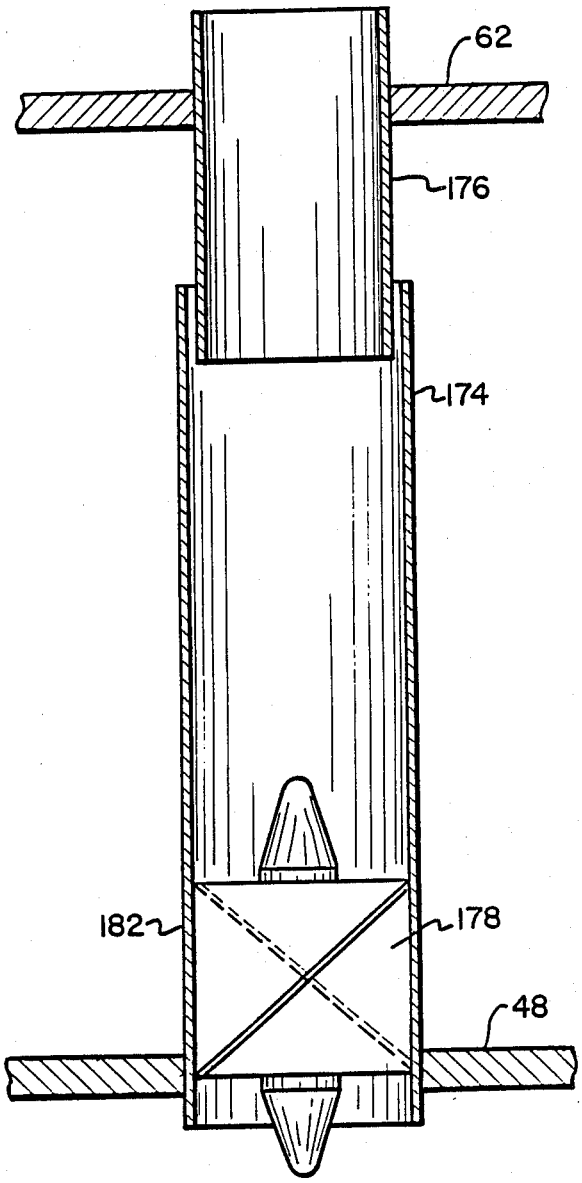
FIG. 11 is a sectioned, elevation view of a fourth embodiment of a steam dryer assembly.

FIG. 11 shows a fourth embodiment of a steam dryer assembly, which is somewhat similar to the embodiment shown in FIG. 3. The diameters of the entrance and exit tubes 174, 176 are somewhat larger than in the first embodiment, due in large part to the use of a different swirler 178, which is situated near the bottom 182 of the entrance tube 174 and which produces a more severe initial helical, swirling action to the wet steam. In this embodiment, the insertion of the swirler into the inlet tube 174 is be easier than with the embodiment associated with FIG. 3, since it has a more limited axial extent.

Each of the embodiments described above has relative advantages and disadvantages in terms of ease of fabrication, material costs and steam velocities in the entrance tube, exit tube and auxiliary flow holes at the ends of the upper plate. Furthermore, each of the embodiments is likely to have a different moisture removal efficiency as a function of steam flow and quality.

The multiple steam dryer arrangement as described above provides a way of producing uniform steam flow to the reheat bundle. Orificing of the top of the exit tubes can be readily performed. In most cases, this would not be necessary as the steam distribution and moisture removal would be substantially uniform from bundle to bundle. The multiple tube assemblies can be readily mass produced and installed into the tube panels or bundles. The tube bundles can be more easily retrofitted to existing MSR's than the chevron type steam dryer.

I claim:

1. A moisture separator comprising:

a wet steam region for containing moisture laden water vapor;

a dry steam region for containing dry water vapor;

an entrance tube fluidly connected to the wet steam region and having an open upper end;

a single helical ribbon extending substantially the full length of the entrance tube, for separating steam flowing through the entrance tube into a substantially liquid stream and a substantially dry vapor stream;

perforations in the upper portion of the entrance tube for extracting the liquid stream from the entrance tube; and at least one additional tube concentrically disposed outside the entrance tube, for capturing the extracted liquid stream and channeling the extracted stream downward along the exterior of the entrance tube.

2. A moisture separator reheater unit comprising:

a horizontally elongated, substantially cylindrical, closed shell;

means in the lower portion of the shell for receiving wet process steam;

means in the upper portion of the shell for heating water vapor;

a pair of opposed upper support fixtures connected to the interior of the shell and extending longitudinally therethrough;

a pair of opposed lower support fixtures connected to the interior of the shell and extending longitudinally therethrough, spaced below the upper support fixtures;

a plurality of multiple tube steam dryer bundles positioned side by side transversely to the shell longitudinal axis, the bundles situated between the means for receiving process steam and the means for heating water vapor, each of said bundels including, a lower plate supported by the lower support fixture, the lower support plate having a plurality of wet steam entry holes therein, a plurality of steam entry tubes secured respectively in the wet steam entry holes and oriented in the direction of steam flow from the means for receiving process steam toward the means for heating water vapor, an upper plate supported by the upper support fixtures, the upper support plate having a plurality of vapor exit holes therein;

a single helical ribbon extending substantially the full length of each entrance tube, for demoisturizing the process steam by separating the steam into a predominantly vapor stream and a predominantly liquid stream, and a plurality of conduit means passing respectively through the steam exit holes, each of said conduit means being coaxially aligned with a respective entrance tube for conducting only said vapor stream from the entrance tube to the means for heating vapor.

3. The moisture separator reheater unit of claim 2 wherein, the steam entry tube has a closed upper end spaced below the upper plate, the means for demoisturizing steam include means adjacent said closed upper end for directing steam radially out of the entrance tube, and conduit means having one open end secured to the upper plate and another open end coaxially surrounding the upper end of the entrance tube and extending downward below said means for diverting the steam radially.

4. The moisture seaprator reheater unit of claim 3, wherein the conduit means has an upper neck portion of a first diameter secured to the upper support plate, a lower skirt portion of a larger, second diameter coaxially surrounding the upper end of the entrance tube, and an intermediate, substantially conical transition portion between the neck and skirt portions.

5. The moisture separator reheater unit of claim 2, wherein, said conduit means includes the open upper end of the entrance tube passing through the upper plate, said means for demoisturinzing include, means within the entrance tube for establishing a helical flow of steam, a plurality of perforation in the upper portion of the entrance tube for directing the separated liquid stream out of the entrance tube, and a jacket tube surrounding the perforations, and sealed against the upper end of the entrance tube, for directing the separated liquid stream downward along the exterior of the entrance tube toward the lower plate.

6. The moisture sepasrator reheater unit of claim 5, wherein of the jacket tube has a lower end spaced from the lower plate and the means for demoisturizing further includes a seal tube having a lower end sealed against the lower plate and the entrance tube, and an upper end surrounding and extending above the lower end of the jacket tube.

7. A moisture separator comprising:

a wet steam region for containing moisture laden water vapor;

a dry steam region for containing dry water vapor;

an entrance tube having a closed upper end, and a plurality of perforations in the wall of the entrance tube adjacent the upper end;

deflection means for separating steam flowing through the entrance tube into a substantially liquid stream and a substantially dry vapor stream, the deflection means including wall means concentrically spaced opposite the perforations for presenting a deflection surface to steam flowing out of said perforations and for directing the resulting wet stream downward; and means for directing the vapor stream into the dry stream region while bypassing said liquid stream, the means for directing includes a funnel portion connected to the wall means for directing the dry stream upwardly to the dry steam region.

8. A moisture separator comprising:

a wet steam region for containing moisture laden water vapor;

a dry steam region for containing dry water vapor;

an entrance tube which has one open end exposed to the wet steam region and another open end exposed to the dry steam region;

deflection means for separating steam flowing through the entrance tube into a substantially liquid stream and a substantially dry vapor stream, the deflection means includes a swirler disposed in the entrance tube for establishing the liquid and the vapor streams, perforations in the upper portion of the entrance tube for extracting the wet stream from the entrance tube, and at least one additional tube concentrically disposed outside the entrance tube, for capturing the extracted liquid stream and channeling the extracted stream along the exterior of the entrance tube wherein said at least one additional tube includes a jacket tube having a first end above said preforations, said first end being mechanically sealed relative to the entrance tube, and a second end below the said perforations, the second end having a water seal relative to the entrance tube, whereby, the extracted liquid stream is channeled downward toward said second end of the jacket tube.

9. The moisture separator of claim 8, wherein said at least one additional tube further includes a seal tube having a lower end sealed relative to the entrance tube below the second end of the jacket tube, and an upper end surrounding the jacket tube above the second end thereof.

10. A moisture separator reheater unit comprising:

a tank having first, second and third internal regions, the first region adapted to receive wet process steam from outside the unit, the second region adapted to receive wet steam from the first region and separate the moisture therefrom, and the third region adapted to receive and reheat the demoisturized, dry steam from the second region;

a first plate situated between the first and second regions;

a second plate situated between the second and third regions;

a plurality of demoisturizer tube assemblies located in the second region between the first and second plates and oriented in the direction of steam travel from the first to the third regions;

each tube assembly including an entrance tube fluidly connecting the first and second regions, an exit tube of smaller diameter than the entrance tube situated partly in the entrance tube and fluidly connecting the entrance tube to the third region, and means located within the entrance tube for imparting a swirling motion to steam passing through the entrance tube;

wherein said second support plate is longer than said first support plate and forms side overhang portions and wherein the overhang portions include a plurality of unobstructed holes;

whereby the liquid content of the wet steam passing through each entrance tube is swept to the wall of the entrance tube and exits the entrance tube into the second region, and the resulting dry steam enters the exit tube and passes into the third region.

11. A moisture separator reheater unit comprising:

a tank having first, second and third internal regions, the first region adapted to receive wet process steam from outside the unit, the second region adapted to receive wet steam from the first region and separate the moisture therefrom, and the third region adapted to receive and reheat the demoisturized, dry from the second region;

a first plate situated between the first and second regions;

a second plate situated between the second and third regions;

a plurality of demoisturizer tube assemblies located in the second region between the first and second plates and oriented in the direction of steam travel from the first to the third regions;

each tube assembly including an entrance tube fluidly connecting the first and second regions, a coaxial exit tube of smaller diameter than the entrance tube situated partly in the entrance tube and fluidly connecting the entrance tube to the third region, and means located within the entrance tube for imparting a swirling motion to steam passing through the entrance tube;

a plurality of alignment pins rigidly connected to one of the first or second support plates, and a corresponding alignment hole in registry with the pin on the other of said first or second support plates, for slidingly receiving the alignment pin, thereby maintaining the coaxial alignment of the respective exit and entrance tubes;

whereby the liquid content of the wet steam passing through each entrance tube is swept to the wall of the entrance tube and exits the entrance tube into the second region, and the resulting dry steam enters the exit tub and passes into the third region.

12. A steam dryer assembly bundle for a moisture separator reheater unit, comprising:

a lower support plate;

a plurality of entrance tubes secured to a respective plurality of holes in the lower support plate and extending vertically therefrom;

an upper support plate which is longer than said lower support plate and forms side overhang portions and wherein the overhang portions include a plurality of unobstructed holes;

a plurality of exit tubes connected to a respective plurality of openings in the upper support plate, said openings and exit tubes aligning coaxially with the respective holes and entrance tubes in the lower support plate;

means associated with at least one of each pair of said entrance tubes and respective aligned exit tube, for separating the liquid from the wet steam entering the entrance tube, and bypassing the separated liquid away from the exit tube, such that demoisturized, dry steam passes from the entrance tube into the exit tube.

13. A steam dryer assembly bundle for a moisture separator reheater unit, comprising:

a lower support plate;

a plurality of entrance tubes secured to a respective plurality of holes in the lower support plate and extending vertically therefrom;

an upper support plate;

a plurality of exit tubes connected to a respective plurality of openings in the upper support plate, said openings and exit tubes aligning coaxially with the respective holes and entrance tubes in the lower support plate;

means associated with at least one of each pair of said entrance tubes and respective aligned exit tube, for separating the liquid from the wet steam entering the entrance tube, and bypassing the separated liquid away from the exit tube, such that demoisturized, dry steam passes from the entrance tube into the exit tube; and a plurality of alignment pins rigidly connected to one of the upper or lower support plates, and a corresponding alingment hole in registry with the pin on the other of said upper or lower support plates, for slidingly receiving the alignment pin, thereby maintaining the coaxial alignment of the respective exit and entrance tubes.

14. The steam dryer bundle of claim 13 further including means located on the upper and lower support plates, for mounting the plates in vertical spaced apart relation to the inner walls of an elongated, substantially cylindrical shell, transverse to the longitudinal axis of the shell.

15. A moisture separator reheater unit comprising:

a horizontally elongated, substantially cylindrical, closed shell;

means in the lower portion of the shell for receiving wet process steam;

means in the upper portion of the shell for heating water vapor;

a pair of opposed upper support fixtures connected to the interior of the shell and extending longitudinally therethrough;

a pair of opposed lower support fixtures connected to the interior of the shell and extending longitudinally therethrough, spaced below the upper support fixtures;

a plurality of multiple tube steam dryer bundles positioned side by side transversely to the shell longitudinal axis, the bundles situated between the means for receiving process steam and the means for heating water vapor, each of said bundles including, lower plate supported by the lower support fixture, the lower support plate having a plurality of wet steam entry holes therein, plurality of steam entry tubes secured respectively in the wet steam entry holes and oriented in the direction of steam flow from the means for receiving process steam toward the means for heating water vapor;

an upper plate supported by the upper support fixtures, the upper support plate having a plurality of vapor exit holes therein and each steam entry tube having an open upper end spaced below the upper plate;

means respectively associated with each entrance tube, for demoisturizing the process steam by separating the steam into a predominantly vapor stream and a predominantly liquid stream, and a plurality of conduit means passing respectively through the steam exit holes, each of said conduit means being coaxially aligned with a respective entrance tube for conducting only said vapor stream from the entrance tube to the means for heating vapor, each conduit means including an exit tube having one open end secured to the upper plate and another open end coaxially received within the upper end of the entrance tube; and an orifice plate in the upper end of each exit tube to establish a predetermined pressure drop through the exit tube.

* * * * *